US006394173B2

(12) United States Patent
Enssle

(10) Patent No.: US 6,394,173 B2
(45) Date of Patent: May 28, 2002

(54) HANGING FOR A ROLLER BLIND WITH LATERAL GUIDANCE

(75) Inventor: Holm Enssle, Hamburg (DE)

(73) Assignee: Bautex Adolf Stover Sohne GmbH & Co. KG, Grasweg (DE)

( * ) Notice: Subject to any disclaimer, the term of this patent is extended or adjusted under 35 U.S.C. 154(b) by 0 days.

(21) Appl. No.: 09/844,806

(22) Filed: Apr. 27, 2001

(30) Foreign Application Priority Data

May 9, 2000 (DE) ..... 100 22 452

(51) Int. Cl.[7] ..... E06B 9/56
(52) U.S. Cl. ..... 160/273.1
(58) Field of Search ..... 160/271, 272, 160/273.1, 268.1, 133, 201, 405

(56) References Cited

U.S. PATENT DOCUMENTS 1,198,456 A * 9/1916 Knapp ..... 160/273.1
1,882,982 A * 10/1932 Schmiedeskamp ..... 160/273.1
4,219,067 A * 8/1980 Hurst ..... 160/133
4,234,033 A * 11/1980 Leivenzon et al. ..... 160/133
5,351,742 A * 10/1994 Lichy ..... 160/273.1

* cited by examiner

*Primary Examiner*—David M. Purol
(74) *Attorney, Agent, or Firm*—Dorsey & Whitney LLP

(57) ABSTRACT

A hanging for a roller blind, which is provided at its lateral edges with guide elements for positive cooperation with lateral guide devices, characterized in that the guide elements are formed by guide strips made from a flexible material, each guide strip being fixed at facing end portions on the hanging and the mutual spacing of the end portions of the guide strip in the fixed state is smaller than in a stretched state of the guide strip, so that a guide area of the guide strip located between the end portions and not joined to the hanging projects from the hanging and can be positively received in a guide device.

11 Claims, 1 Drawing Sheet

HANGING FOR A ROLLER BLIND WITH LATERAL GUIDANCE

BACKGROUND OF THE INVENTION

The invention relates to a hanging for a roller blind or window shade, which is provided at its lateral edges with guide elements for positive cooperation with lateral guide devices.

A roller blind hanging is known, which is provided on each of its lateral edges with a "half slide fastener," so that in cooperation with a guide groove, a welt effect is obtained. A significant disadvantage of such a guide system is that on rolling the blind up onto a winding roller the "half slide fasteners," acting as guide elements, are superimposed to form beads, which brings about a creasing of the hanging and leads to an increased space requirement around the winding roller.

Another known possibility for the lateral guidance of a roller blind hanging consists of the hanging being provided on its lateral edges with rivets or the like, but this also leads to the aforementioned disadvantages.

The problem solved by the invention is to so improve a hanging so that on rolling up there is no longer any bead formation or bulging as a result of the superimposed guide elements.

SUMMARY OF THE INVENTION

According to the invention this problem is solved by a hanging for a roller blind, which is provided on its lateral edges with guide elements for positive cooperation with lateral guide devices. The hanging is characterized in that the guide elements are formed by guide strips made from a flexible material. Each guide strip is fixed to facing end portions on the fixed hanging and the mutual spacing of the end portions of the guide strip in the fixed state is smaller than in a planar or stretched state of the guide strip, so that a guide area of the guide strip located between the fixed end portions and not connected to the hanging projects in convex manner from the hanging and can be positively received in a guide device.

Preferably the guide strips are rectangular and are positioned parallel to the lateral edges of the hanging.

The guide strips are appropriately located on an outer hanging surface during rolling up.

Preferably the mutual spacing of the end portions of the guide strips fixed to the hanging are so adapted to the diameter of a winding roller receiving the hanging that on rolling up the guide areas engage substantially flat on the hanging.

Preferably the guide strips are made from a plastic film, particularly an embossed polyester film. Preferably the guide strips are joined to the hanging by ultrasonic welding or bonding.

Alternatively a single, continuous guide strip is connected at intervals with the hanging, accompanied by the formation of projecting guide areas.

The invention also relates to a roller blind with a hanging and two lateral guide devices for receiving the guide strips. It is possible for each guide device to have a guide rail with an undercut-like guide groove with a narrowed guide portion for the passage of the hanging and a widened reception portion for receiving the guide strip or the guide areas projecting from the hanging.

The invention also relates to a method for the manufacture of the hanging, which is characterized by the following steps: providing a cylindrical or cylinder sector-shaped working template or stencil, whose diameter corresponds to the diameter of a winding roller used with the hanging, placing an area of a lateral edge of the hanging to be provided with a guide strip on the working template in accordance with the curvature thereof, placing a guide strip on the area of the lateral edge corresponding to the curvature thereof, placing a guide strip on the area of the lateral edge corresponding to the curvature thereof, joining facing end portions of the guide strip to the hanging, particularly by ultrasonic welding or bonding, so that a guide area of the guide strip located between the end portions connected to the hanging and not actually connected to the hanging projects in curved manner therefrom in the stretched state.

BRIEF DESCRIPTION OF THE DRAWING

Further advantages and features of the invention can be gathered from the following description of an embodiment with reference to the attached drawings, wherein.

DESCRIPTION OF A PREFERRED EMBODIMENT

Figure 1:
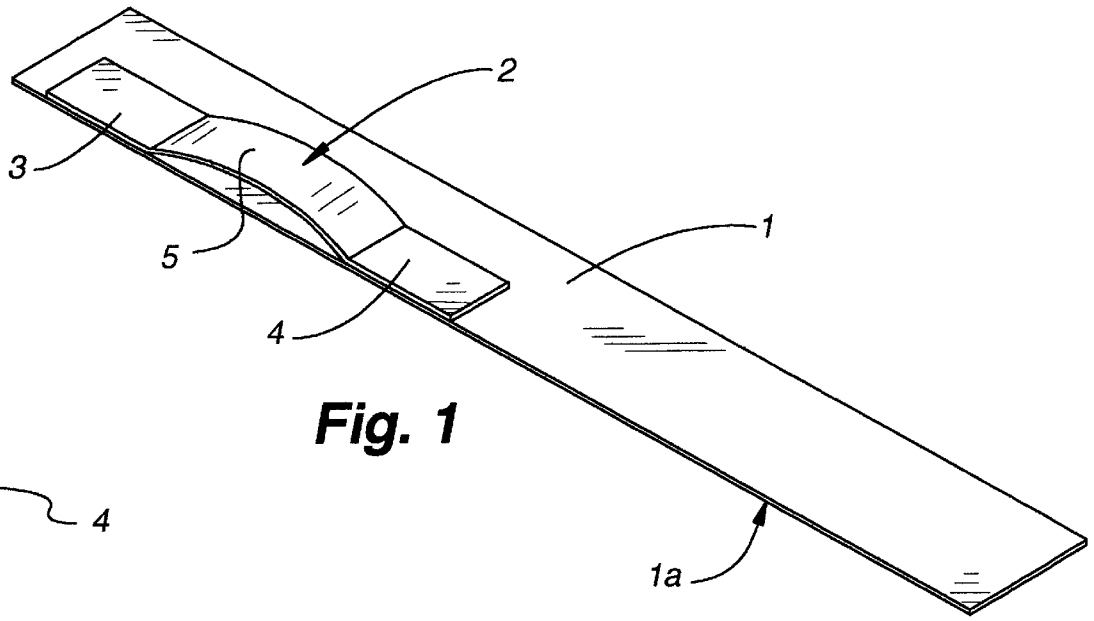
FIG. 1 shows a marginal area of a hanging for a roller blind provided according to the invention with a guide strip.

In FIG. 1, a detail of a hanging 1 for a roller blind or window shade is shown with a lateral marginal area with a lateral edge 1*a* of the hanging material. According to the invention for forming a guide element, a guide strip 2 made from a flexible or pliable material is applied to the edge of the hanging. As shown in FIG. 1, the elongated guide strip 2 is joined at its facing end portions 3, 4 to the hanging material, e.g. by bonding or ultrasonic welding, whereas a central area or guide area 5 located between the end portions 3, 4 is not joined to the hanging. Due to the fact that the end portions 3, 4 of the guide strip 2 are fastened with a smaller mutual spacing on the hanging 1 than corresponds to the stretched length of the guide strip, the guide area 5 projects in wavy or curved manner from the hanging 1. The height of the guide area 5, i.e. the spacing between the guide area 5 and the hanging material below it, is largely determined by the overall length of the guide strip 2 and the extent by which the mutual spacing of the end portions 3, 4 is reduced compared with the stretched state.

Figure 2:
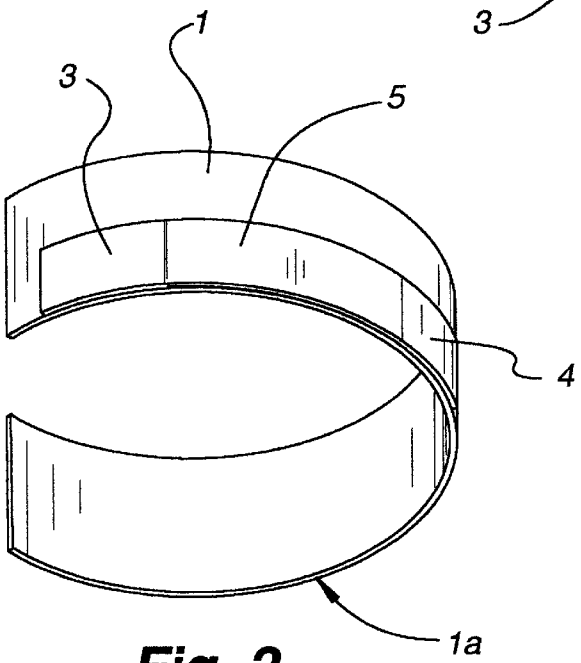
FIG. 2 shows the marginal area of the hanging of FIG. 1 in a curved state.

FIG. 2 shows the detail of the hanging 1 shown in FIG. 1 in a curved state. The diameter of the hanging portion approximately corresponds to the diameter of a winding roller onto which the hanging is to be rolled when used in a rolling blind. As shown in FIG. 2, the guide area 5 of the guide strip 2, in the represented curved or rolled up state, engages on the hanging 1, so that the total thickness of the hanging in the marginal area shown, as opposed to the planar or unrolled state in FIG. 1, merely corresponds to the sum of the hanging thickness and the guide strip thickness. As a result, the hanging can easily be rolled onto a winding roller, because unlike in the known, prior art solutions, there is no creasing as a result of a significantly increased roll-up diameter. In order to achieve this advantage it is obvious that the guide strips are located on the side of the hanging away from the winding roller, i.e. on the outside when rolling up and as shown in FIG. 2.

Figure 3:
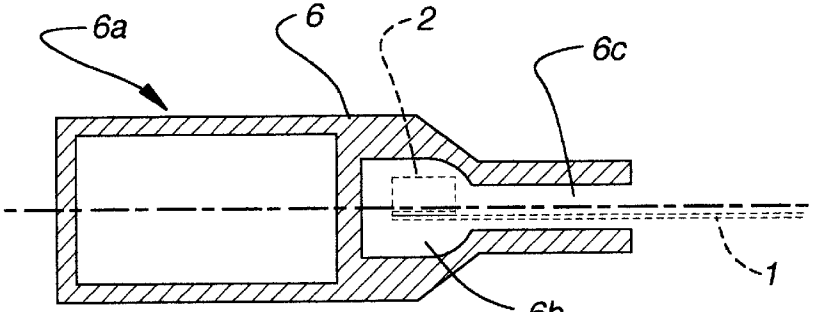
FIG. 3 shows a diagrammatic sectional view of a guide device for a hanging, the latter being shown in broken line form.

FIG. 3 illustrates the arrangement of a hanging 1 according to the invention, provided with guide strips 2, in a guide rail 6, which, in addition to a fastening area 6*a*, has an undercut-like guide groove with a reception portion 6*b* for receiving the marginal area of the hanging 1 provided with the guide strips, as well as a narrowed guide portion 6*c* for the passage of the hanging 1. The inside width of the guide portion 6*c* must obviously be smaller than the total thickness of the hanging in the vicinity of a guide strip 2, so as to ensure guidance of the hanging.

Different requirements with respect to the guidance characteristics of the guide strips can be implemented by the material characteristics thereof (stiffness, elasticity, flexibility, etc.), number and dimensions (length, width, spacing of the guide area from the hanging), etc.

A conventional hanging material for a roller blind is, according to the invention, provided with guide strips. Initially a cylindrical or cylinder sector-shaped working template is provided, whose diameter corresponds to the diameter of a winding roller to be used with the hanging or an average diameter of the hanging material to be wound onto a winding roller. In each case an area of a lateral edge of the hanging to be provided with a guide strip is placed thereon in accordance with the curvature of the template and guide strip is placed on said area of the lateral edge, once again in accordance with its curvature, which leads to an arrangement corresponding to the finished hanging portion according to FIG. 2. Then facing end portions of the guide strip are joined to the hanging material, particularly by ultrasonic welding or bonding, which fixes an arrangement according to FIG. 2. This ensures in the simplest possible way that the mutual spacing of the two end portions of the guide strip is such that the unconnected guide area has a best possible engagement on the hanging when the hanging is rolled up.

What is claimed is:

1. A hanging for a roller blind provided with guide elements for positive cooperation with a lateral guide device wherein said guide elements are formed by guide strips made from a flexible material, each said guide strip being fixed at facing end portions on one side of the hanging with the mutual spacing of the end portions of said guide strip in its fixed state being smaller than in a stretched state of said guide strip so that a guide area of said guide strip located between the fixed end portions projects outwardly from said hanging to be received in a guide member.

2. A hanging according to claim 1 wherein said guide strips are rectangular and positioned parallel to the lateral edges of said hanging.

3. A hanging according to claim 1 wherein said guide strips are located on a hanging surface which is on the outside of the hanging on rolling up.

4. A hanging according to claim 1 wherein the mutual spacing of the end portions of said guide strips fixed to the hanging is selected to adapt to the diameter of a winding roller receiving the hanging that the guide areas smoothly roll up when said hanging is rolled up.

5. A hanging according to claim 1 wherein said guide strips are made from a plastic film.

6. A hanging according to claim 5 wherein said guide strips are made from embossed polyester film.

7. A hanging according to claim 1 wherein said guide strips are joined to the hanging by ultrasonic welding or bonding.

8. A hanging according to claim 1, wherein a guide strip is joined at intervals to the hanging, accompanied by the formation of projecting guide areas.

9. A roller blind assembly having a plurality of hangings with each said hanging provided with guide elements for positive cooperation with a lateral guide device, said guide elements being formed from a flexible material with each said guide element formed by guide strips fixed at facing end portions on one side of the hanging with the mutual spacing of the end portions of said guide strip in its fixed state being smaller than in a stretched state of said guide strip so that a guide area of said guide strip located between the fixed end portions projects outwardly from said hanging, a guide member in said roller blind assembly to positively receive said guide area of said guide strips.

10. A roller blind assembly according to claim 9 wherein said guide member includes a guide rail with an undercut guide groove provided with a narrow guide portion to accommodate said hanging and a widened reception portion for receiving the projecting portion of said guide strips.

11. A method for the manufacture of a hanging comprising the steps of:

providing a cylindrical or cylinder sector-shaped working template, whose diameter corresponds to the diameter of a winding roller to be used with the hanging;

placing an area of a lateral edge of the hanging to be provided with a guide strip on the working template in accordance with the curvature thereof; placing a guide strip on the area of the lateral edge corresponding to the curvature thereof; and joining facing end portions of the guide strip to the hanging by ultrasonic welding or bonding so that upon removal from said working template said guide strip projects outwardly from said hanging at a mid-portion thereof.

* * * * *